US005146635A

United States Patent [19]

Gastle et al.

[11] Patent Number: 5,146,635

[45] Date of Patent: Sep. 15, 1992

[54] VETERINARY SURGERY TABLE

[76] Inventors: Thomas H. Gastle, Lakefield, Canada, K0L 2H0; James E. Gastle, P.O. Box 430, Lakefield, Ontario, Canada, K0L 2H0

[21] Appl. No.: 521,996

[22] Filed: May 11, 1990

[30] Foreign Application Priority Data

Jun. 1, 1989 [CA] Canada ..... 601523

[51] Int. Cl.[5] ..... A61G 13/00

[52] U.S. Cl. ..... 5/620; 119/103; 248/164; 108/118

[58] Field of Search ..... 248/164, 432; 108/118; 297/441; 269/322, 139; 119/103

[56] References Cited

U.S. PATENT DOCUMENTS 164,386 6/1875 Merrick ..... 248/164
1,653,764 12/1927 Goodwin ..... 248/164
4,057,291 11/1977 Dubinsky ..... 297/441
4,103,883 8/1978 Shepherd ..... 269/289 MR
4,328,992 5/1982 Ohanian ..... 108/118
4,415,149 11/1983 Rees ..... 269/139
4,428,326 1/1984 Dubovick et al. .
4,974,525 12/1990 Sheffield ..... 248/164

*Primary Examiner*—Robert C. Watson

[57] ABSTRACT

Disclosed herein is a veterinary surgery table comprising frame means including a pair of frame portions, flexible support means extending between the frame portions to support an animal thereon and a plurality of adjustment means located at spaced locations along the support means to adjust the span of the support means between the frame portions so as to conform to the shape of the outer surface of the animal thereby minimizing the discomfort experienced by the animal during the surgery.

3 Claims, 9 Drawing Sheets

VETERINARY SURGERY TABLE

The present invention relates to veterinary surgery tables.

It is common in the veterinary profession to operate on a calf when it is placed on its back in a position known in the profession as 'dorsal recumbency'. Often such procedures must be performed on the floor of a barn and a pair of bales are placed along each side of the calf to support it in position. Consequently, the veterinarian must operate on his knees. Although a widely accepted technique, operations of this type have numerous shortcomings.

Firstly, the back of a calf has a triangular shape which means that the recumbent position is difficult to maintain when the calf is on a flat floor. The bales are in many cases too light to provide sufficient lateral support to the calf which means that the veterinarian must also use his body to support the calf. It is also uncomfortable for the veterinarian to perform the operation on his knees. Finally, sterile conditions are difficult to maintain resulting in the calf being placed in undue risk.

It is desirable, therefore, to provide a technique for supporting the calf in dorsal recumbency which secures the calf in position, improves the comfort of the veterinarian and allows sterile conditions to be maintained.

It is an object of the present invention to provide a novel veterinary surgery table.

Briefly stated, the invention involves a veterinary surgery table a pair of frame portions, flexible support means extending between said frame portions to support an animal thereon and a plurality of adjustment means located at seccessive locations along said frame to vary the span of said support means between said frame portions; each of said adjustment means constituting means to adjust the span of a segment of said support means at a given location along said frame portion; support means and said adjustment means together constituting means to permit said table to be adjusted in order to support an animal in a number of possible configurations including lateral and dorsal recumbency, while conforming to the animal's shape inorder to minimize the discomfort experienced by said animal during said surgery.

Preferred embodiments of the present invention will now be described, by way of example only, as illustrated in the appended drawings, in which.

Figure 1:
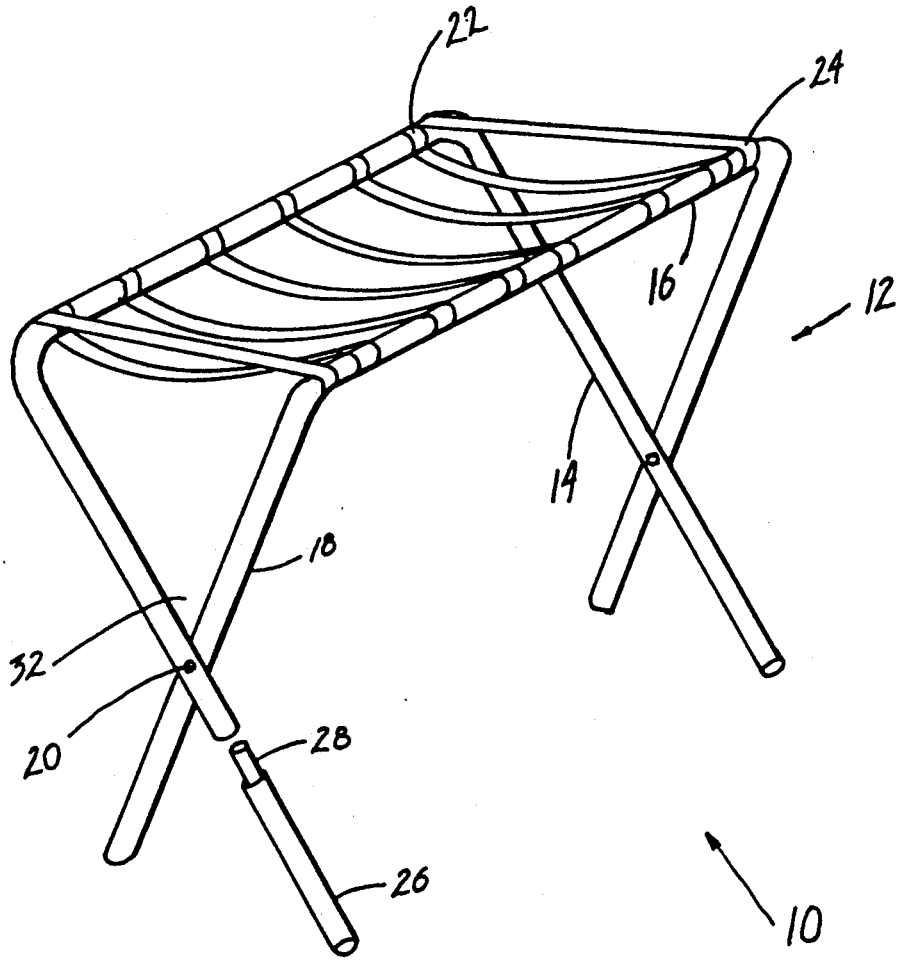
FIG. 1 is a perspective view of an operating table.
Figure 2:
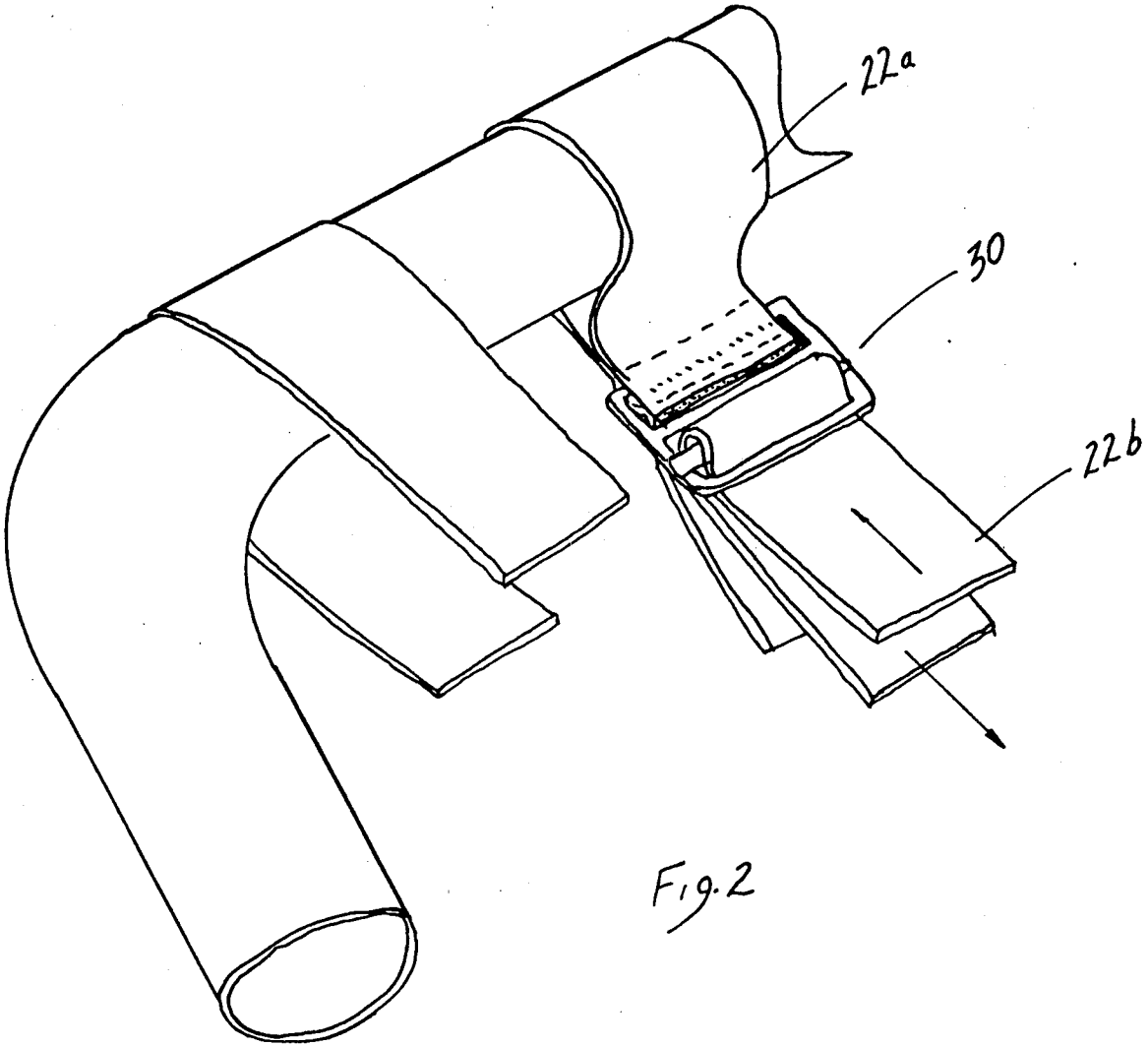
FIG. 2 is a magnified perspective fragmentary view of one portion of the table illustrated in FIG. 1.
Figure 3:
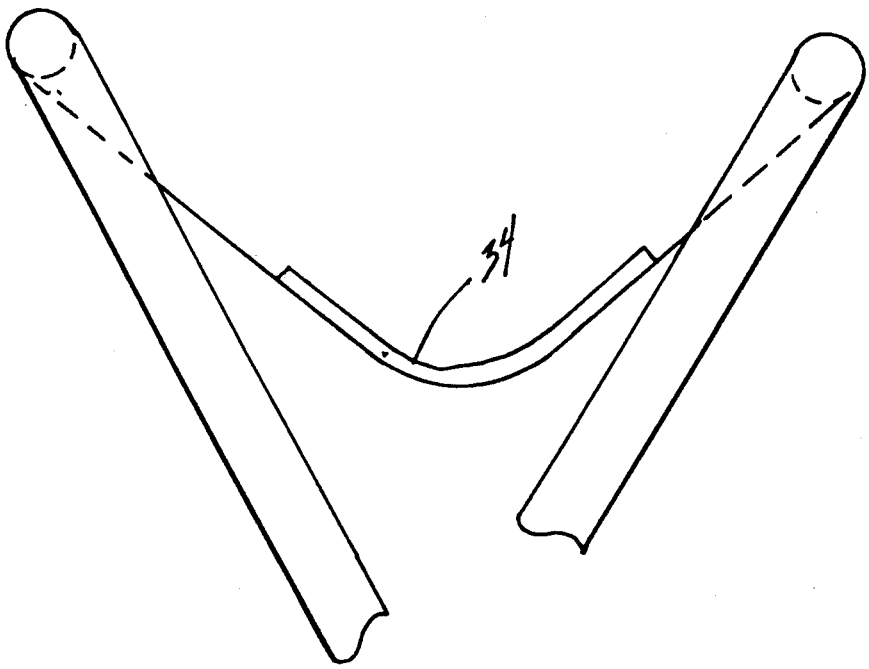
FIG. 3 is a side view of a portion of an alternative surgery table.
Figure 4:
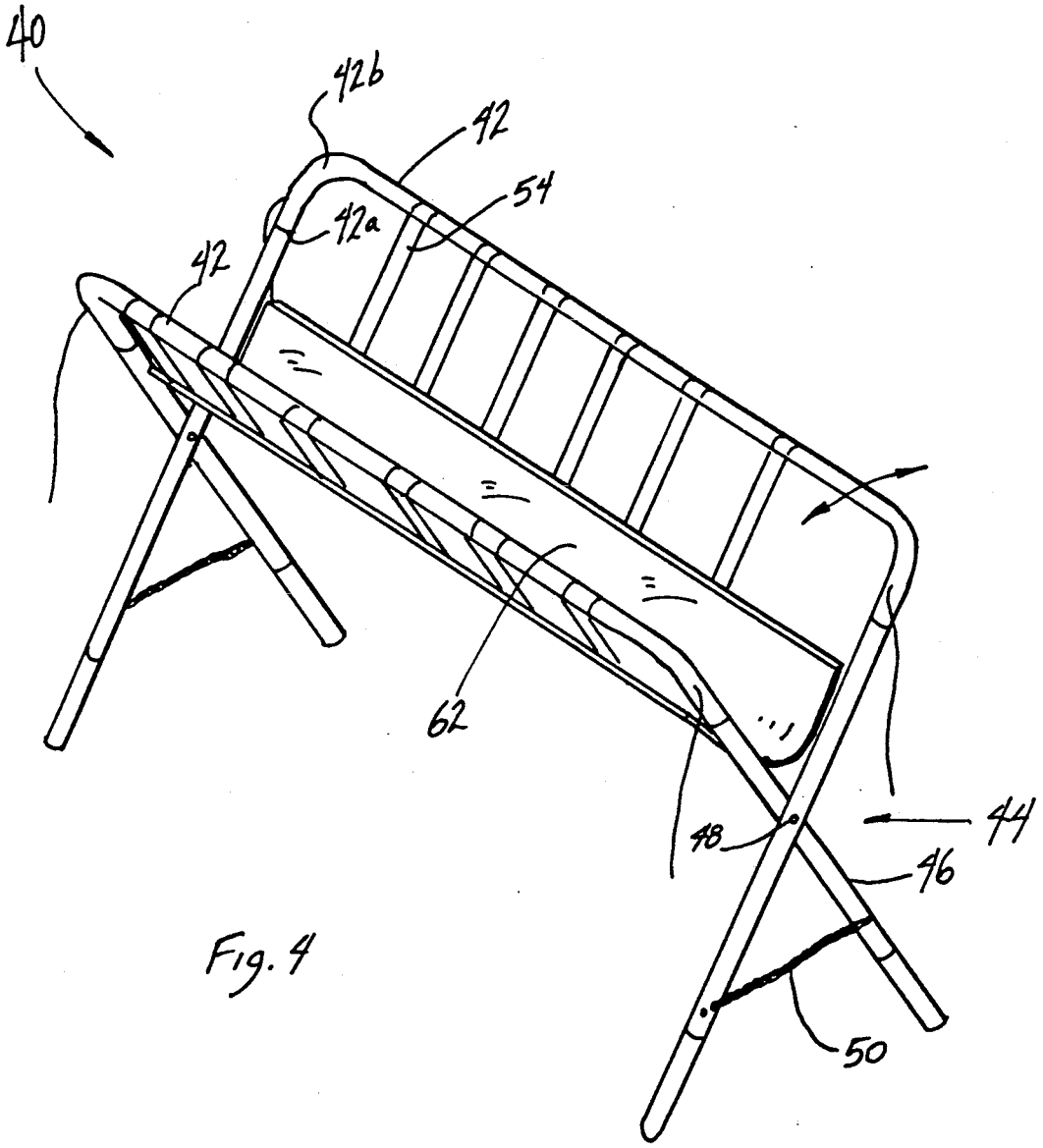
FIG. 4 is a partly schematic perspective view of another surgery table.
Figure 5:
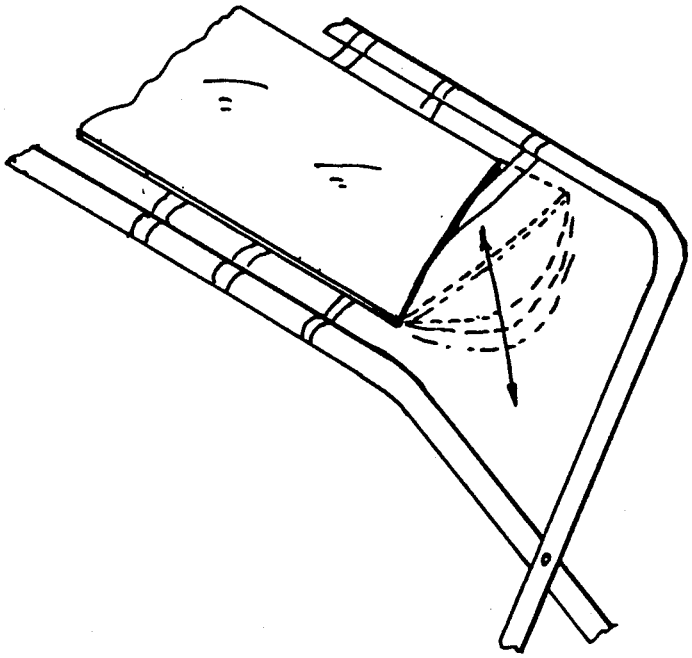
FIG. 5 is a fragmentary perspective view of the table shown in FIG. 4.

Referring to FIGS. 1 to 3, there is illustrated a surgery table 10 formed from a pair of inverted U-shaped frame members 12 and 14 formed from a beam 16 and a pair of legs 18 depending therefrom at a bend 19. The frame members are pivoted to one another by a pivot pin 20 extending through adjacent pairs of legs at each end of the table 10.

Extending between the beams 16 is a flexible support means in the form of a number of belts 22. These belts 22 support the calf in its dorsal recumbency position and are adjustable for reasons to be explained.

There is provided an additional pair of belts 24 which extend between the beams 16 and which also are adjustable in length. These belts 24 enable the separation of the frame members 12 to be adjusted according to the dimensions of the calf.

Each leg 18 is secured to the bend 19 and has a free end 18*a*. An extension portion 26 is provided with a swaged end 28 which is telescopingly engaged with the free end 18*a*. This enables the overall length of the leg 18 to be reduced for portability and transport.

Referring to FIG. 2, each of the belts 22 has one end 22*a* which is looped around one of the beams 16 and sewn on itself. The belt 22 extends across the gap separating the beams 16 around the other beam and returns to an adjustment means in the form of a buckle 30 which is anchored to the end of the belt 22*a*. The belt 22 is then passed through the buckle to be engaged with a toothed portion thereof. The free end of the belt 22*b* then emerges on top of the return portion thereof to allow the length of the belt 22 to be adjusted merely by pulling the free end 22*b*.

The belts 24 at each end of the table are provided with an adjustment means in the form of a buckle of similar construction to that used on the belts 22 between the beams. However, it will be recognized that any configuration of buckle or other adjustment means for that matter may be used on the belts 22, 24 provided that their length may be adjustable.

The frame members 12 are formed from a light weight mild carbon steel tubing which is sturdy yet allows the table to be portable from site to site with ease by the veterinarian. However, it is to be understood that other materials may be used to form the frame including plastic and fiberglass. Regardless of construction, it is recommended that the frame so-formed have a strength sufficient to carry an animal having a weight in excess of 300 pounds.

In use, the table is assembled by inserting each of the extension portion into the free end of a respective leg. The table is then put in an upright position, the legs spread to the approximate diameter of the calf's body.

The calf is then lifted onto the belts by the veterinarian and an assistant if necessary. The triangular shape of the calf's back is easily supported by the belts in a sling like fashion. However, if any of the belts do not provide sufficient support, the free end of that belt may be pulled until the desired support is obtained.

This is a significant feature of the table as it ensures that the calf is equally supported at several locations along its length regardless of the shape of its back. Furthermore, the belts ensure that the pressure on the back is not localized in the region of the apex of the triangular shape thereof, i.e. in the region of the spine. This significantly reduces the risk of injury or pressure sores to the calf during surgery.

When the calf is placed in the dorsal recumbency position the front and rear feet are anchored to the belts by way of velcro straps, binder twine or any other suitable strap.

In some cases, the neck and head region of the calf may extend beyond the straps. However, the V-Shaped notch formed by the pivoted legs as illustrated at 32 in FIG. 1 provides a convenient support yoke for this region.

In the alternative enbodiment as illustrated in FIG. 3, a resilient support pad 34 is mounted on top of the straps to provide further support for the calf. In this case, the pad may be resilient foam material as long as it is resistant to alchohol, iodine and other surgical preparations.

Although the above mentioned embodiments have restricted to discussion of the calf in dorsal recumbency, it will be understood that the table can be used for the calf in other positions, for example in lateral recumbency (that is on its side) as the table can be adjusted so that the belts are sufficiently tight to maintain the calf above the beams of the table. In addition, the table may be used for any species of the animal as long as the animal can be lifted onto the table. For example, sheep caesareans are commonly performed with the animal in lateral recumbency.

In yet another alternative embodiment, the belts may be replaced by a netting material which extends the length of the beam. In this case, adjustment means in the form of hooks may be provided at given locations along the length of the beams to anchor the netting material at a desired location thereon. Of course, the netting must have a sufficient strength to carry the animal.

Another portable surgery table 40 is shown in FIGS. 4 to 9. The table has a pair of beams, each with a pair of ends 42*a* and a pair of corners. A pair of scissored leg 46 arrangements 44 are coupled to the beams 42 to complete the table 40 frame. Each arrangement 44 has a pair of legs 46 pivoted together by a pivot bolt 48. Each of the legs 46 has a swaged upper end to fit within the end 42 and a lower end 46*b*. A leg extension 49 having a swaged upper end 49*a* is telescopingly engaged with the lower end 46*b* of a respective leg. A chain 50 is attached to each leg 46 in each arrangement 44 and is located beneath the pivot bolt 48. Each of the beams 42 has a pair of anchor ropes 52 each of which is anchored to a respective corner of the beam.

Several belts 54 are distributed along the length of the beams 42. Each belt 54 is doubled over both beams 42. One free end of the belt 54 is looped over one of the beams 42 and is fastened against the belt 54 by way of a pair of clips to form a loop 58. A buckle 60 is entrained in the loop 58. The other end of the belt 54 extends across the span between the two beams 42 and doubles back to pass through the entry point of the buckle.

Figure 7:
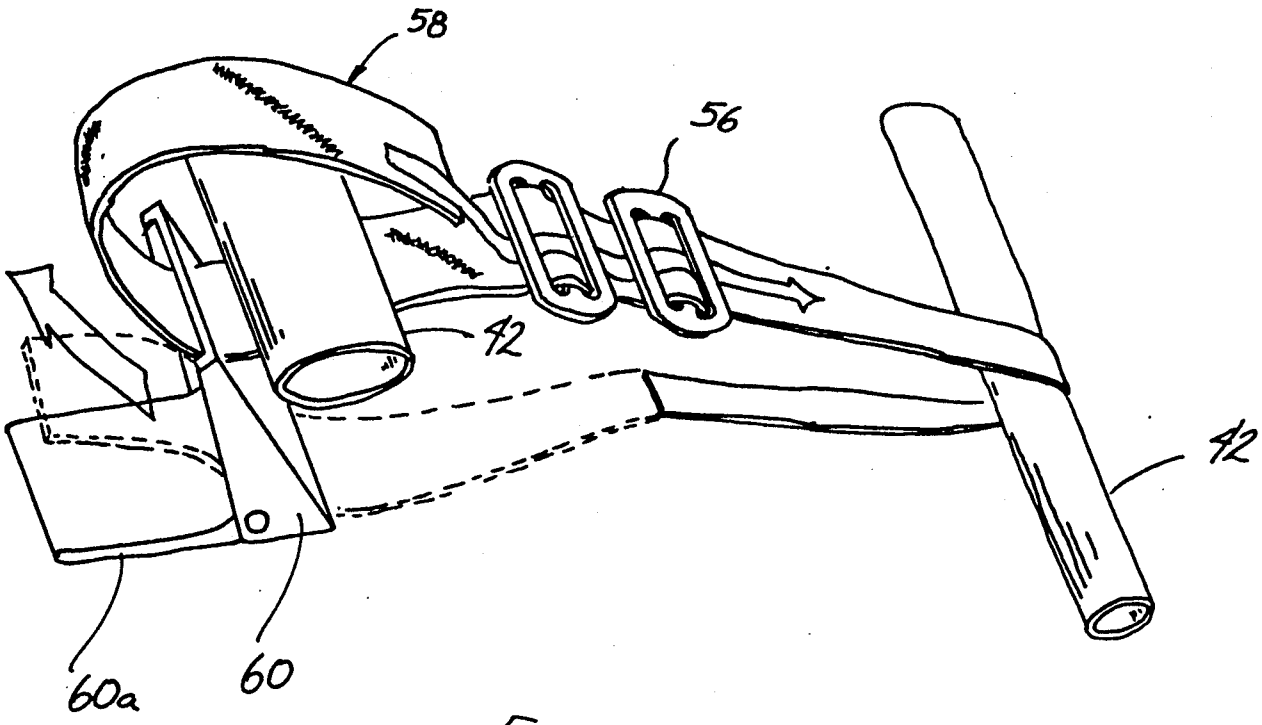
FIG. 7 is an exploded fragmentary perspective view of a portion of the table shown in FIG. 4.
Figure 8:
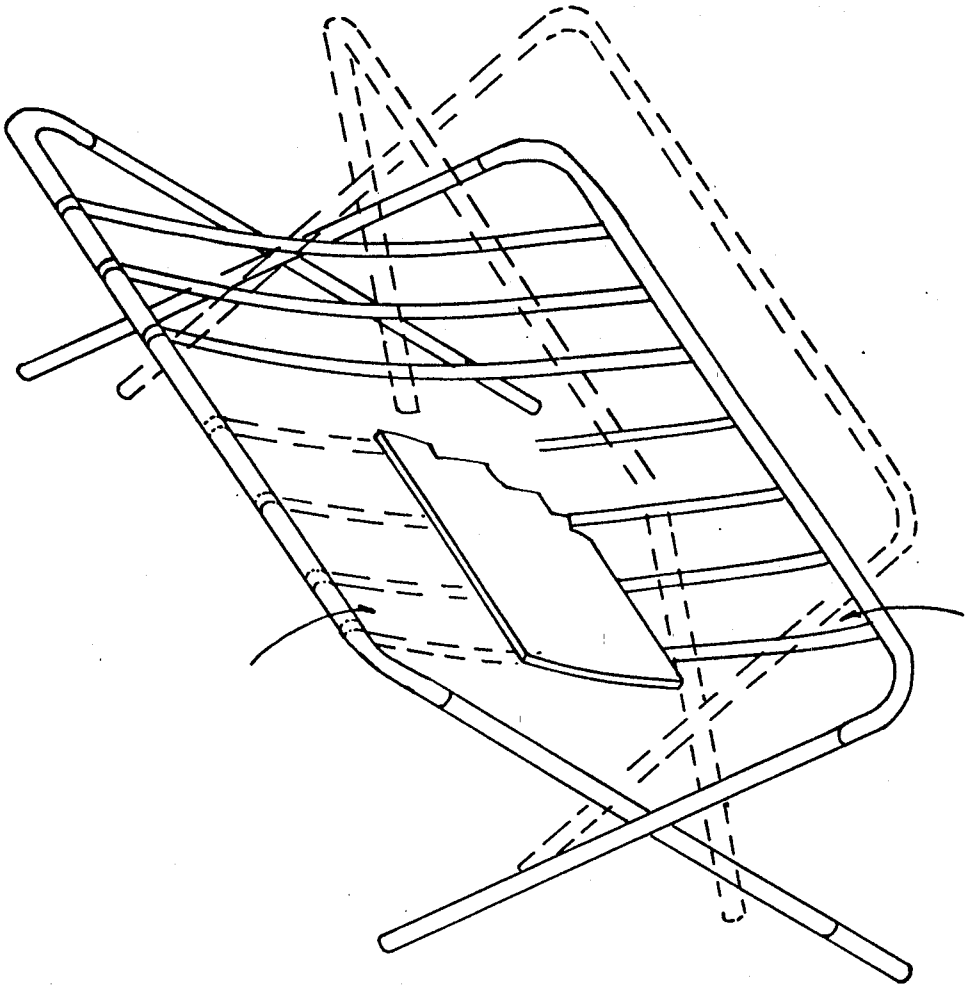
FIG. 8 is another partly schematic perspective view of the table shown in FIG. 4.

As can be seen in the FIG. 7, the buckle 60 is the type having a cam-lever 60*a* which is pivoted to a base 60*b*. Pushing the cam-lever 60*a* to a position against the base 60*b* causes a cam surface, not shown, to be wedged between a pair of abutments. When the cam-lever 60*a* is released, the abutments are separated causing the belt 54 to be released.

A particular feature of the buckle/belt 54 arrangement 44 is the ability of the cam-lever 60*a* to be released by outwardly forcing the belt 54 against the lever. This permits the veterinarian with a means rapidly to release the buckle 60 with the animal on the belts 54 without attempting to open the buckle 60 against the weight of the animal.

A foam pad 62 is located on the belts 54. The foam may be of any suitable 40 material, for example, cross linked polyethylene with an integral skin.

Figure 9:
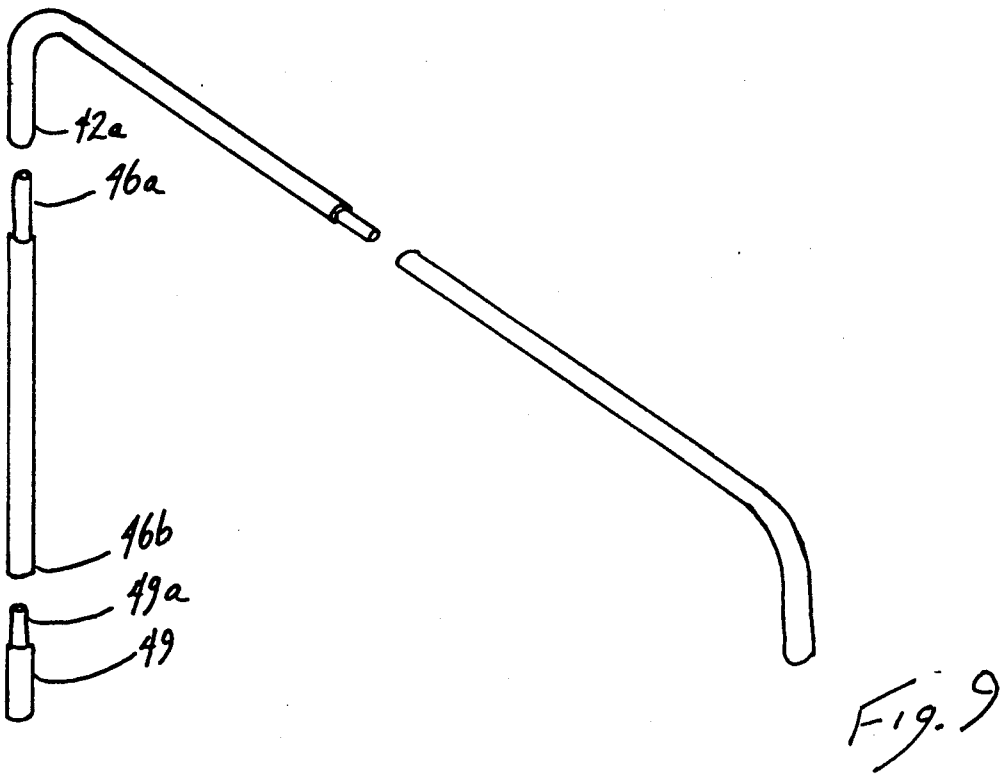
FIG. 9 is a perspective view of a portion of another surgery table.

An alternative embodiment is shown in FIG. 9 wherein the beam is segmented. This permits to be the beam disassembled for ease of transport and storage.

In use, the table 40 is assembled as shown in the figures.

A particular feature of the table 40 is the versatility it gives the veterinarian when preparing the table 40 and the animal for surgery.

If the animal is particularly heavy, it may be inconvenient to lift the animal onto the table 40. In this case, the veterinarain may lower the frame to a position shown in solid lines in FIG. 8, where the beams 42 are positioned below the belly of the animal. This can be done by releasing the chain 50 and increasing the length thereof between the legs. The buckles are each released. The length of the span of belts 54 between the beams 42 is increased until belt 54 is taut between the beams 42. The buckles are then closed.

With the table 40 in this position, the animal may simply be tipped onto the table 40 and its legs 46 tied down with the appropriate anchor ropes 52. The frame may then be raised to a position sufficiently high for the veterinarian to operate in comfort. If desired, the belts 54 may be shortened to bring the surgical field above the beams 42.

If the animal is light enough to be lifted by the veterinarian onto the table 40, the veterinarian may wish to adjust the height of the frame by simply adjusting the chains 50 accordingly. The belts 54 may then be adjusted to give the appropriate depth in relation to the beams 42.

Figure 6:
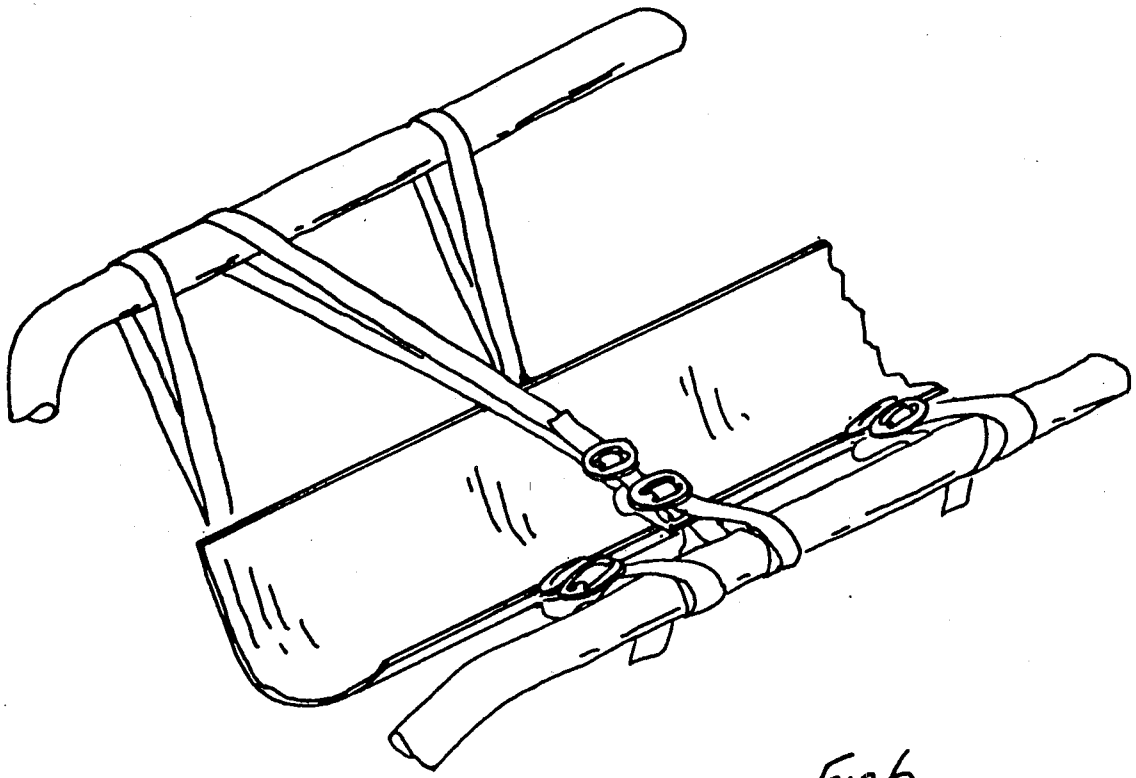
FIG 6 is another fragmentary perspective view of the table shown in FIG. 4.

Should the veterinarian wish to perform the surgery on a dorsally recumbent animal, such as for abdominal surgeries on calves, he can adjust the length of the belts 54 so that they are sufficiently below the beams 42 so that the belly of the animal will lie just above the beams 42. In this case, when the animal is placed on the belts 54, the beams 42 may be drawn together until they rest against the side of the trunk. This may be accomplished by shortening the chain 50 or by using two cross belts 54 as shown in FIG. 6. The cross belts 54 are especially useful when an assistant is unavailable as they permit the veterinarian to fix the position of the table 40 while being in control of the animal.

For surgical conditions requiring lateral recumbancy, the belts 54 may be adjusted so that they are taut between the beams 42. In this case, the animal's abdomen is completely above the beams 42. For example, caesarians are done on sheep in a laterally recumbent position, that is with the animal on its side.

Another particular feature of the table 40 is the versatility offered by the use of the leg 46 extensions 49. They not only enable the table 40 to be lowered for shorter vets, they can be used to put the table 40 on an incline, as may be useful for example when operating on small pigs. The table 40 may be inclined by pulling two extensions 49 from one end. The inclination may be increased by inserting the two removed extensions 49 into ends 42*a* of the two remaining extensions 49 at the other end of the table 40.

The table 40 is lightweight and portable 40. To disassemble the table 40, the leg 46 arrangements 44 are removed from the beams 42. With the belts 54 still on the beams 42, the beams 42 and leg 46 arrangements 44 may be conveniently packed in an appropriately sized bag.

In summary, the table 40 has several features which are of significant benefit to the veterinarian.

1) Animals in general have different trunk widths and depths. The table 40 allows depth adjustment by adjusting the belts 54 and width adjustment by adjusting the beams 42 before or after the animal is placed in the table 40; this adjustment allows the operating surface to be above the beams 42 and the trunk against the beams 42, thereby preventing rotation during surgery.

2) Table 40 accomodates all possible surgical positions within the weight range. Sheep, goats pigs C-Sections lateral recumbancy; Calves and pigs—hernias, bowell abnormalities—dorsal recumbancy.

3) The table 40 can be set at various heights to receive the animal. Heavier animals can be tipped onto the table 40. Lighter animals can lifted onto the table 40.

4) The table 40 accomodates various veterinarian heights by removing extensions 49 or lowering the beams 42. This allows the veterinarian to operate with minimum discomfort.

We claim:

1. A veterinary surgery table comprising a pair of frame portions having a distance therebetween, said frame portions including a pair of inverted U-shaped members, each having a beam and a pair of legs depending from each end thereof. said members being pivotally mounted to one another by a pivot means extending through said legs at a point spaced from said beams. flexible support means extending between said frame portions to support an animal of a given width thereon and thereby forming an animal support bed, said support means having a length and a number of segments along said length, said bed having a width and a depth, a plurality of first adjustment means located at successiuve locations along said frame to vary the length of an individual segment of said support means between said frame portions; second adjustment means for adjusting the distance between said frame portions, said first and second adjustment means together constituting means to configure said animal support bed by adjusting said width and depth according to the type of surgery to be undertaken on said animal; said frame portions being movable from a relatively low position to receive said animal to a relatively high position for surgery on said animal wherein a veterinarian can operate in comfort.

2. A surgery table comprising a pair of frame portions having a distance therebetween, said frame portions including a pair of inverted U-shaped members, each having a beam and a pair of legs depending from each end thereof, said members being pivotally mounted to one another by a pivot means extending through said legs at a point spaced from said beams, each of said legs having a free end, a plurality of leg extension members, each for removable attachment to one said free ends, said leg extension members constituting means to adjust the height of said table, flexible support means extending between said frame portions to support an animal of a given width thereon and thereby forming an animal support bed, said support means having a length and a number of segments along said length, said bed having a width and a depth, a plurality of first adjustment means located at successive locations along said frame to vary the length of an individual segment of said support means between said frame portions; second adjustment means for adjusting the distance between said frame portions, said first and second adjustment means together constituting means to configure said animal support bed by adjusting said width and depth according to the type of surgery to be undertaken on said animal: said frame portions being movable from a relatively low position to receive said animal to a relatively high position for surgery on said animal wherein a veterinarian can operate in comfort.

3. A veterinary surgery table comprising a pair of frame members, each having a beam and a pair of legs depending from each end thereof, said frame members being pivotally mounted to one another by a pivot means extending through said legs at a point spaced from said beams, said beams having a distance therebetween, flexible support means extending between said frame portions to support an animal thereon and thereby forming an animal support bed having a width and a depth, said flexible support means including a plurality of belts disposed along said beams, first adjustment means to adjust independently the length of each belt between said beams, said adjustment means constituting means to configure said animal support bed by adjusting said width and depth according to the type of surgery to be undertaken on said animal and the shape of said animal; second adjustment means for adjusting the distance between said frame portions, said frame portions being movable from a relatively low position to receive said animal to a relatively high position for surgery on said animal and wherein a veterinarian can operate in comfort.

* * * * *